United States Patent [19]

Porter

[11] Patent Number: 4,519,164

[45] Date of Patent: May 28, 1985

[54] GATE WITH MULTIPLE PIVOT AXES FOR RAIL MEMBERS

[76] Inventor: Richard A. Porter, P.O. Box 11, Kittridge, Colo. 80457

[21] Appl. No.: 569,484

[22] Filed: Jan. 9, 1984

[51] Int. Cl.[3] ..... E05C 7/06

[52] U.S. Cl. ..... 49/108; 49/109; 49/340

[58] Field of Search ..... 49/108, 107, 109, 104, 49/340, 324, 385, 381

[56] References Cited

U.S. PATENT DOCUMENTS

| | | | |
|---|---|---|---|
| 606,250 | 6/1898 | Stout | 49/385 X |
| 1,511,697 | 10/1924 | Westby | 49/104 X |
| 1,536,360 | 5/1925 | Stewart | 49/324 |
| 2,807,107 | 9/1957 | Goulet | 49/385 X |
| 4,330,958 | 5/1982 | Richmond | 49/340 X |

*Primary Examiner*—Philip C. Kannan

*Attorney, Agent, or Firm*—Gregg I. Anderson

[57] ABSTRACT

A gate for use in an opening along a barrier includes a support post having a plurality of rails pivotally connected thereto and an end support for supporting the free ends of the rails is shown. Each of said rails move in parallel vertical planes. A system for interconnecting the pivotal movement of the rails relative to said support post provides concurrent movement of the respective rails.

7 Claims, 11 Drawing Figures

GATE WITH MULTIPLE PIVOT AXES FOR RAIL MEMBERS

BACKGROUND OF THE INVENTION

1. Field of the Invention

The present invention relates to gates for spaced openings along barriers. More particularly, the present invention relates to a gate wherein the closure member or members of the gate are moveable in a vertical plane to open and close the gate.

2. Brief Description of the Prior Art

Gates having closure members, such as rails, which are pivotally connected to a post for movement in a vertical plane are widely known in railroad crossing and parking lot applications. Such a vertically opening closure member is seen in U.S. Pat. No. 3,925,930 to J. Gail et al. Gail shows a two-piece arm, a first piece pivotly connected to a post and the second piece pivotly connected to a terminal end of the first piece. A third piece pivotly connects to the support post and then to the second piece so that vertical movement of the first piece lowers a free end of the second piece and pulls the second piece toward the support post, opening the gate.

A single closure member gate that has two different types of pivotal movement positions is seen in U.S. Pat. No. 3,394,498 to W. Reinitz et al. Reinitz discloses a vertically opening railway gate that upon collision swing horizontally, as would a door. The single closure member of the gate of Reinitz includes three telescoping segments, defining a colinear closure member.

Coplanar closure members, acting in the same plane, such as vertically opening doors and cable systems to open such doors are also known. Such a vertically opening door or gate is seen in U.S. Pat. No. 3,394,497 to J. Case. The gate is integral and does not brake or articulate as is seen in Gail. A window grill including integrally connected horizontal and vertical members is seen in U.S. Pat. No. 4,000,590 to C. Kordewick. The Kordewick grill swings in a horizontal plane and also has two pivot points in the horizontal members allowing for a second type of articulation, again in a horizontal plane.

OBJECTS AND SUMMARY OF THE INVENTION

The principal object the present invention is to provide a gate that opens vertically and yet is lightweight, compact and does not involve any overhead mechanism.

It is a related object of the present invention to provide a gate, including a plurality of closure members or rails, each pivotally connected to a support post for movement in parallel vertical planes so as not to interfere with each other.

It is a further related object of the present invention to provide a gate having a plurality of closure members, the closure members interconnected for concurrent movement with each other.

It is a still further related object of the present invention to provide a gate having a plurality of closure members interconnected for concurrent movement, where the pivotal movement of at least some of the closure members is damped for smooth and continuous movement relative to other of the closure members.

It is a still further object of the present invention to provide a gate having a plurality of closure members, including a counterbalance for assisting in the operation of the movement of the closure members.

In accordance with the objects of the present invention, a gate for filling an open space along a barrier such as a fence includes a support post system to which a plurality of closure members or rails are pivotally connected and an end post system upon which a free end of each rail rests when the gate is in the closed position. The support post system includes a plurality of vertical members, one for each rail and an additional member to which drive means are secured. In pockets between adjacent vertical members, an interconnecting mechanical link or cable system is mounted and connects the drive means to each one of the rail members near their pivot points. Each pocket defines a plane, in which plane one of the plural rails moves without interference from the other rails.

The link or cable interconnection system is damped and counterbalanced for ease of movement of the separate interconnected rails. The end support post system is constructed so as to support a free end of each of the rail members and allow passage of the free ends upon upward or downward vertical movement of the rails to open or close the gate.

DESCRIPTION OF THE PREFERRED EMBODIMENTS

Figure 1:
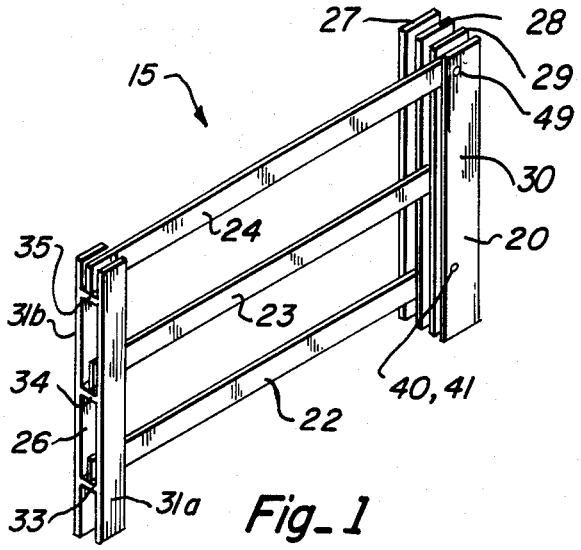
FIG. 1 is a perspective view of a gate of the present invention shown in a closed position.

A preferred embodiment of a gate 15 in accordance with the present invention is shown in FIGS. 1 through 8. A pivotal support post 20 is positioned at one end of the gate 15, to which post 20 a lower gate rail 22, a middle gate rail 23 and a top gate rail 24, defining closure members, are pivotally connected. The free end of each of the gate rails 22, 23, and 24 rests on an end support post 26 at the other end of the gate 15. An opening in a barrier or fence (not shown) exists between the support post 20 and the end post 26.

The support post 20 includes a lower rail vertical or upright member 27, a middle rail vertical or upright member 28 and a top rail vertical or upright member 29, as well as a drive vertical or upright member 30. The vertical members 27, 28, 29 and 30 are elongated plates of generally rectangular solid configuration secured in a foundation (not shown). The members 27, 28, 29 and 30 each define separate spaced apart parallel planes. As can be seen there is an upright vertical member 27, 28 and 29 associated with each gate rail 22, 23 and 24 and an additional vertical member 30.

The end post 26 is similarly constructed and includes a pair of vertical or upright members 31*a* and 31*b*. The vertical members 31*a* and 31*b* are elongated plates of generally solid rectangular configuration. The vertical end members 31*a* and 31*b* are oriented in a parallel manner defining a space therebetween for receipt of the free ends of the rails 22, 23 and 24. In the space between the vertical members 31*a* and 31*b*, a lower landing 33 interconnects the members 31*a* and 31*b* and supports the lower gate rail 22. (FIGS. 1 and 3) In an identical manner a middle landing 34 connects the vertical members 31*a* and 31*b* and supports the middle gate rail 23 when the gate 15 is in the closed position. Finally, a top landing 35 interconnects the members 31*a* and 31*b* and supports a free end of the top gate rail 24.

Figure 3:
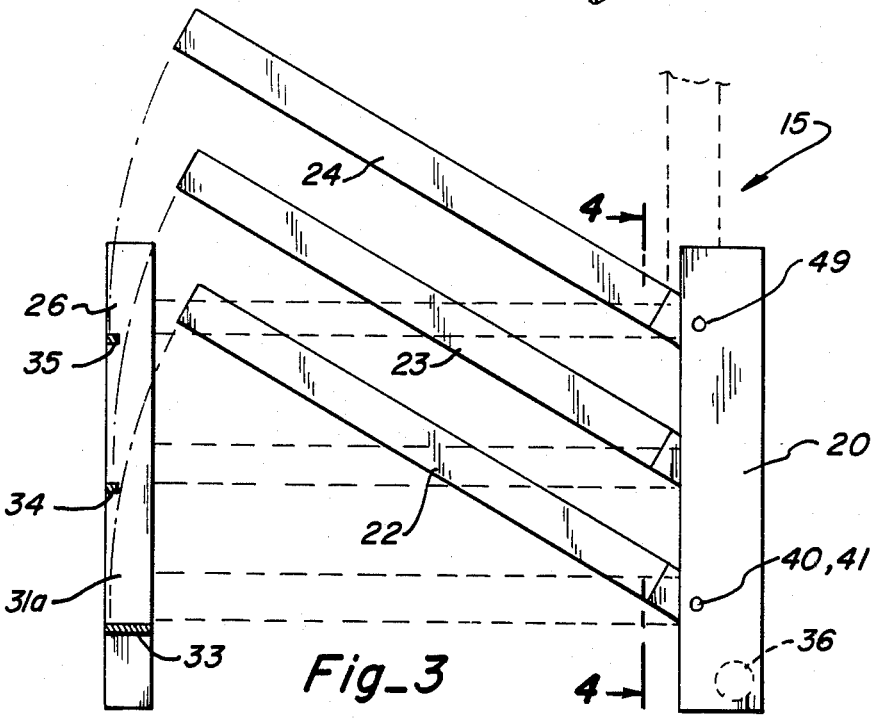
FIG. 3 is a side elevational view of the invention shown in FIG. 1 in a position intermediate the open and closed positions.
Figure 4:
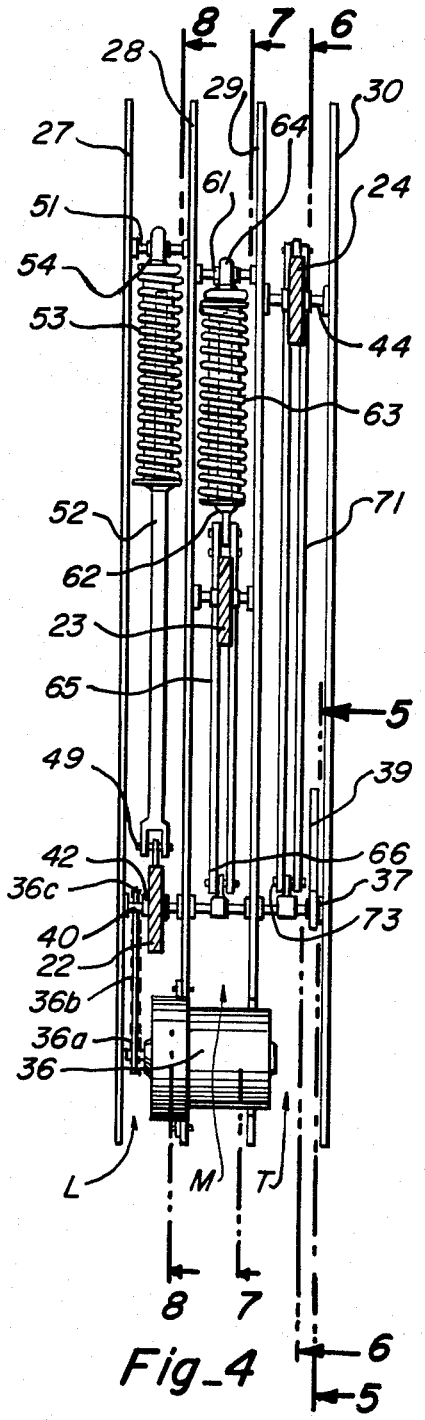
FIG. 4 is a sectional view taken in the plane of line 4—4 of FIG. 3.
Figure 5:
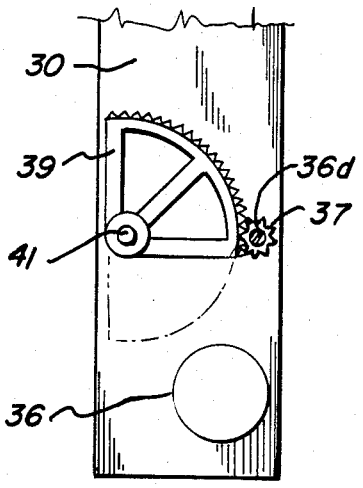
FIG. 5 is a fragmentary sectional view taken in the plane of line 5—5 of FIG. 4.

As seen in FIGS. 3 and 4, the free ends of the rails 22, 23 and 24 move in vertical planes parallel to the parallel planes in which all of the vertical members 27, 28, 29, 30 and 31*a* and 31*b* lie. It is also seen that the parallel vertical members 27, 28, 29 and 30 define three pockets, a first pocket L, between the lower vertical member 27 and the middle vertical member 28, a second pocket M between the middle vertical member 28 and the top vertical member 29 and a third pocket T between the top rail vertical member 29 and the drive vertical member 30.

The pockets L, M and T are each essentially coplanar with the vertical movement of the respective rails 22, 23, and 24 associated therewith. The lower rail 22 moves vertically in a plane coplanar with pocket L. The lower rail 22 is pivotally connected to the post 20 between the lower vertical member 27 and middle vertical member 28. The movement of the middle rail 23 and top rail 24 are identical with respect to pockets M and T respectively. The middle rail is pivotally connected to the post 20 between the middle vertical member 28 and the top vertical member 29, while the top rail 24 is pivotally connected to the post 20 between the top vertical member 29 and the drive vertical member 30.

The plurality of rails 22, 23 and 24 are therefore seen to be pivotly connected to the support post 20. Each of the rails 22, 23 and 24 moves vertically and in a coplanar relationship with an associated pocket L, M or T respectively. The free end of the rails 22, 23 and 24 are supported on the landing 33, 34, and 35 of the end post 26. The landings 34 and 35 have a relatively narrow dimension so that the movement of the free end of the rails 22 and 23 pass the landings 34 and 35 without interference (FIG. 3).

Figure 6:
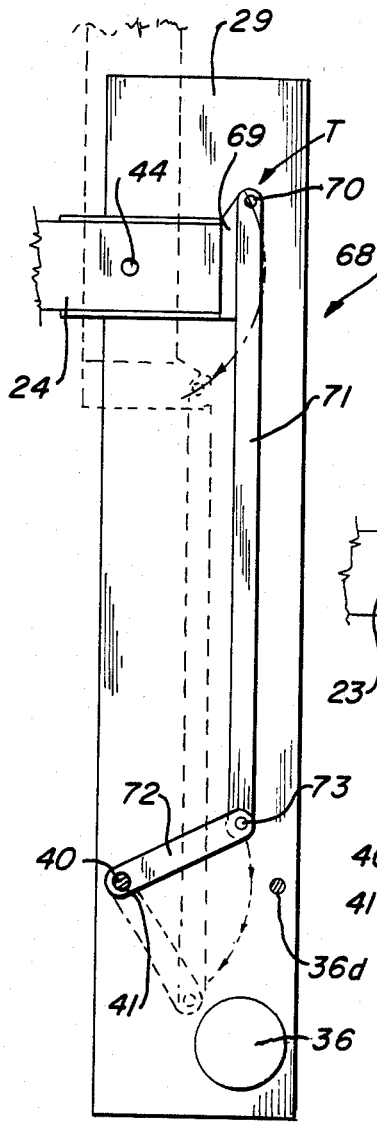
FIG. 6 is a fragmentary sectional view taken in the plane of line 6—6 of FIG. 4.
Figure 7:
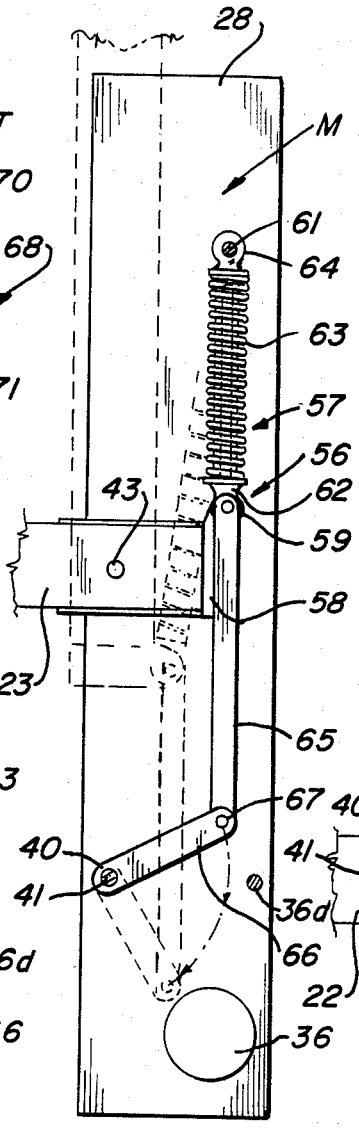
FIG. 7 is a fragmentary sectional view taken in the plane of line 7—7 of FIG. 4.
Figure 8:
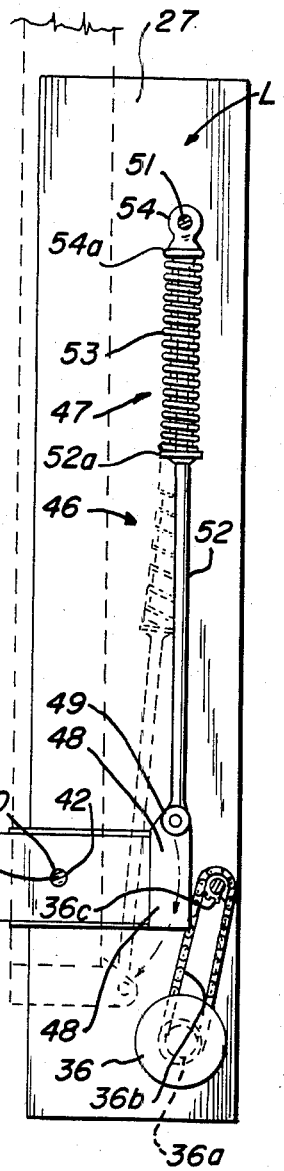
FIG. 8 is a fragmentary sectional view taken in the plane of line 8—8 of FIG. 4.

The pockets L, M and T have mounted therein a lower rail link system 46, a middle rail link system 56 and a top rail link system 68 respectively (FIGS. 6, 7 and 8). The link systems are driven by the motor 36 which is mounted in a cavity provided at the lower end of the support post.

Figure 2:
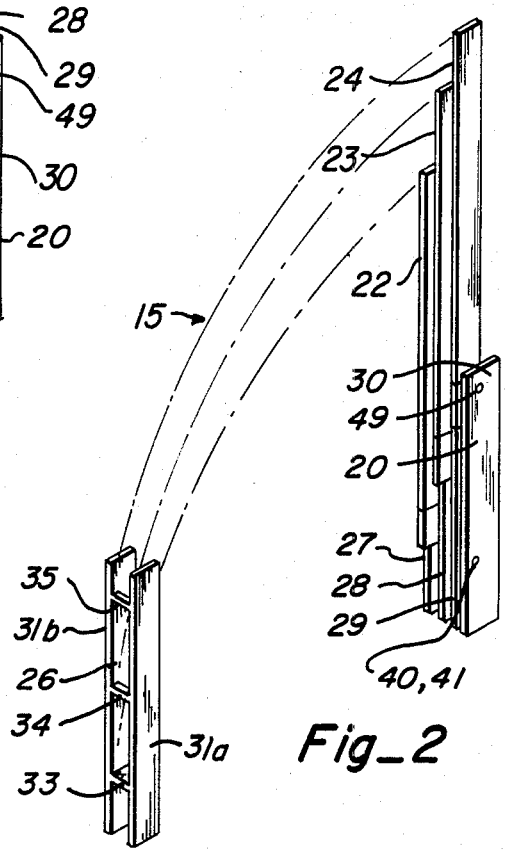
FIG. 2 is a perspective view of the invention shown in FIG. 1 in an open position.

The motor is mounted on vertical member 28. The drive shaft of the motor is directed toward vertical member 27 and carries a drive sprocket 36*a* disposed adjacent the vertical member 27. Drive sprocket 36*a* is connected by a chain 36*b* to a driven sprocket 36*c* carried on a transversely extending idler shaft 36*d* the opposite end of which carries a pinion gear 37. The pinion gear 37 is meshed with a pivot or swing gear 39 which is secured to a pivot rod 40 extending through the support post 20 and defining a drive axis 41. The pivot gear is movable through an arc of 90 degrees to move the rails 22, 23, and 24, via the rail link systems 46, 56 and 68 respectively, between a horizontal closed position (FIG. 1) and a vertical open position (FIG. 2).

The lower rail link system 46 (FIG. 8) is contained in the pocket L situated between the lower rail vertical member 27 and the middle rail vertical member 28. A pivot end of the lower rail 22 is fixedly connected to the drive rod 40 for pivotal movement about a pivot point 42. The drive rod 40 has a longitudinal axis coincident with the drive axis 41. It is, therefore, seen that the lower rail 22 is directly pivoted by the pivot rod 40.

A counterbalance spring assembly and damping means 47 is pivotly connected to a rail link or end cap 48 of the lower rail 22 at rail link pivot point 49, through a conventional pin-type connection. The spring assembly 47 biases the rail link 48 downwardly about the lower rail pivot axis 41 to assist in raising the lower rail 22 from the horizontal to the vertical position as will be explained in more detail later.

The spring assembly 47 includes an elongated shank 52 connected at one end to the rail link or end cap 48 at pivot point 49. The shank 52 is slidably received in telescopic fashion in a tubular connector 54 of the spring assembly 47 for slidable movement relative thereto. The tubular connector 54 is pivotally secured at its upper end to a fixed pivot point 51 by an axle supported by the lower vertical member 27 and the middle vertical member 28. The shank has an abutment ring 52*a* fixed approximately midway along its length to abut the lower end of a spring 53. The spring 53 which abuts an abutment ring 54*a* at the top of the tubular connector 54 biases the shank 52 downwardly from the fixed connector 54 to counterbalance the weight of the lower rail 22 when the gate 15 is being opened. This counterbalancing action acts through the lever arm defined between the lower rail pivot point 42 and the rail link pivot point 49. The spring assembly 47 also allows some movement of the link system 46 relative to the other link systems 56 and 68, thus preventing the interconnected link systems from unwantingly binding and wearing. During the raising or lowering of the lower rail 22, the link system 46 is seen therefore to act through a single moving pivot point 49 and the fixed pivot points 42 and 51.

The middle link system 56 is established between the middle vertical member 28 and top vertical member 29 of the post 20 in pocket M. (FIG. 7). The middle rail 23 is mounted on an axle journaled between members 28 and 29 and pivots about a middle rail pivot point 43. The pivot point 43 is in vertical alignment with the drive axis 41. A second counterbalance spring assembly and damping means 57 is associated with the middle rail link system 56 and includes an elongated shank 62 slidably connected in a telescopic fashion to a tubular fixed point connector 64. The shank 62 and tubular connector 64 are biased apart by an intermediate spring 63 confined between abutment rings carried on the shank and tubular connector. The shank 62 is connected to a rail link or end cap 58 of the middle rail 23 by a pin at a rail link pivot point 59. The fixed tubular connector 64 is secured at its upper end to an axle journaled at either end to members 28 and 29 for pivotal movement between the middle vertical members about a fixed point pivot point 61.

The upper end of a middle rail link arm 65 is pivotally connected by a pin connection to the middle rail link or end cap 58 at pivot point 59, with the lower end of the middle rail link arm 65 being pivotally connected by a pin to one end of a drive link 66 at pivot point 67. The other end of the drive link 66 is secured to the pivot rod 40 for pivotal movement about the drive axis 41. As seen in FIG. 7 the drive link 66 moves 90 degrees in moving the middle rail 23 from a horizontal to a vertical position.

The second spring assembly 57 acts in a manner identical to that of the first mentioned spring assembly 47 to counterbalance the weight of the middle rail 23. The bias in the spring 63 acts through the lever arm defined between the middle rail pivot point 43 and the middle rail link pivot point 59 to assist in raising the middle rail 23. It is seen that there are three fixed pivot points in the middle link assembly 57, fixed point 61, rail pivot point 43 and drive axis 41 and two moving pivot points 59 and 67.

The top rail link system 68 is mounted in the pocket T between the top rail vertical member 29 and the drive vertical member 30 of the post 20. (FIG. 6) The top rail 24 is mounted on an axle journaled at each end to members 29 and 30 and is pivotal about a top rail pivot point 44. The top rail pivot point 44 is aligned vertically with the drive axis 41. A rail link or end cap 69 of the top rail 24 is pivotly connected by a pin connection to the upper end of a top rail link arm 71 at rail link pivot point 70. The lower end of the top rail link arm 71 is pivotally connected by a pin connection to one end of a second drive link 72 at link pivot point 73. The other end of the drive link 72 is securely fixed to the pivot rod 40. As was the case in the middle link system 56, the drive link 72 is moved through an arc of 90 degrees to move the top rail 24 between a vertical or open position as seen in FIG. 8 and a horizontal or closed position. Fixed pivot points 41 and 49 and moving pivot points 70 and 73 are features of the top link system 68.

It is seen that all of the rail pivot points 42, 43 and 44 do lie in a vertical plane perpendicular to the vertical plane in which the rails 22, 23 and 24 move. The link systems 46, 56 and 68, are operated by pivotal movement of pivot rod 40, and thereby define means for interconnecting the rails 22, 23, and 24 for concurrent movement in their respective non coplanar vertical planes.

Figure 9:
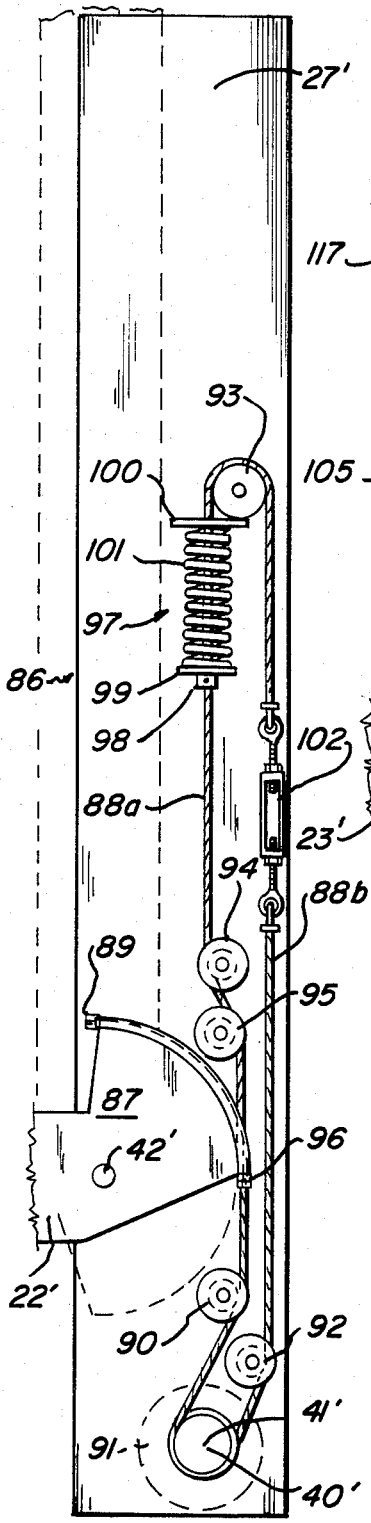
FIG. 9 is a fragmentary sectional view of an alternative embodiment of the invention shown in FIGS. 1 through 8, illustrating a cable interconnecting system similar to the link interconnecting system, shown in FIG. 6.
Figure 10:
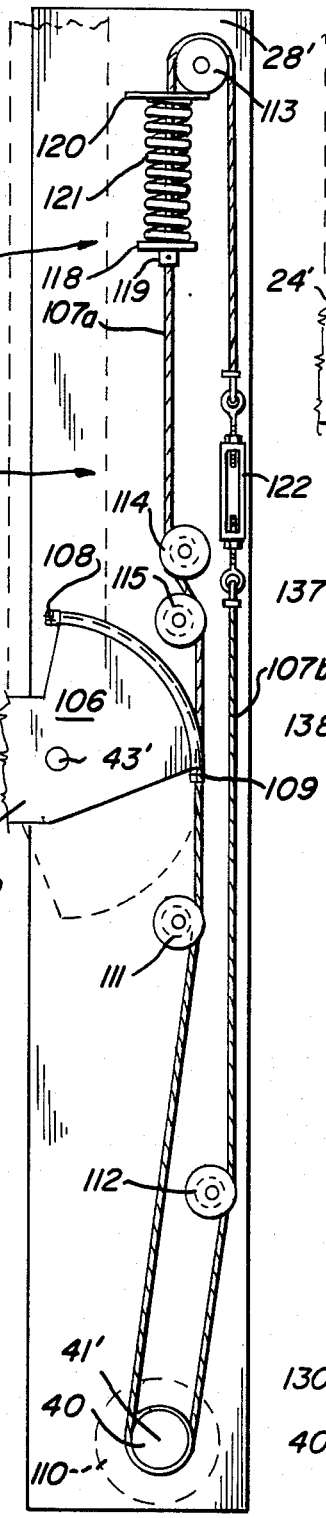
FIG. 10 is a fragmentary sectional view of an alternative embodiment of the invention shown in FIGS. 1 through 8 illustrating a cable interconnecting system similar to the link interconnecting system shown in FIG. 7.
Figure 11:
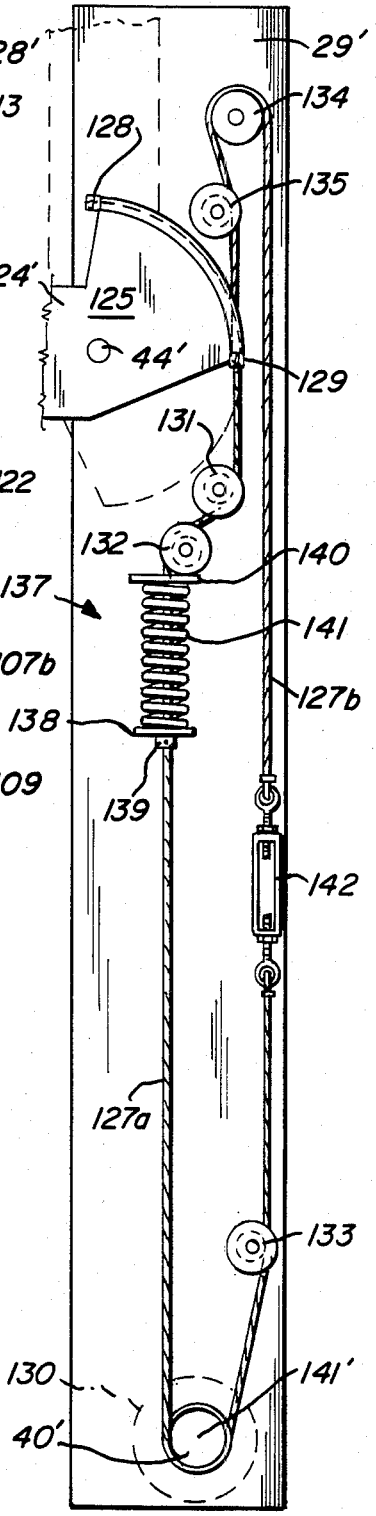
FIG. 11 is another fragmentary sectional view of an alternative embodiment of the invention shown in FIGS. 1 through 8, illustrating a cable interconnecting system similar to the link interconnecting system shown in FIG. 8.

In an alternative embodiment like parts being given prime suffixes, seen in FIGS. 9 through 11, interconnecting cable systems 86, (FIG. 9), 105 (FIG. 10) and 125 (FIG. 11) replace the link systems 46, 56, and 68 respectively. The lower rail 22′ includes an arcuate end portion 87 mounted for pivotal movement about point 42′ which is fixidly connected to cable segments 88*a* and 88*b*. The cable segment 88*b* is attached to arcuate portion 87 at point 89 and passes over an idler pulley 90 around a drive pulley 91 and idler pulley 92 before being anchored to the lower end of a toggle 102. Cable segment 88*a* is anchored to the upper end of toggle 102 and extends around idler pulleys 93, 94 and 95 before being connected to arcuate portion 87 at point 96. Drive pulley 91 is connected directly to the pivot rod 40′. All the pulleys 90, 91, 32, 93, 94 and 95 are mounted on axles extending between members 27′ and 28′.

The lower cable link system 86 further includes a counterbalance spring assembly and damping means 97. The spring assembly 97 includes a fixed lower plate 99 at point 98, an upper plate 100 which is slidable with respect to the cable segment 88*a* and a compression spring which is coaxially mounted relative to the cable between the fixed plate 99 and the slidable plate 100. Counterclockwise rotation of the drive pulley 91 by the drive means 36 will raise the lower rail 22′ ultimately placing the upper plate 100 the spring assembly 97 into abutting contact with idler pulley 93. The compression of spring 101 is released as the lower rail 22′ is raised thus assisting the motor. Upon lowering the rail 22′, the spring 101 is again compressed. Cable tension adjustment is provided by the toggle connector 102.

The middle cable interconnecting system 105 raises and lowers the middle rail 23′. An arcuate portion 106 on the end of the middle rail 23 has one end of a lower cable segment 107*b* connected at point 108 and the end of an upper cable segment 107*a* connected at point 109. Though not specifically shown, all the arcuate portions of the rails 22′, 23′ and 24′ include appropriate tracks or grooves for seating of the cables. A drive pulley 110 is turned counterclockwise to raise the rail member 23′. The cable segment 107*b* passes over drive pulley 110 and idler pulleys 111 and 112 before being connected to the lower end of a toggle 122. The cable segment 107*a* is anchored to the upper end of the toggle and passes around idler pulleys 113, 114 and 115 before being connected to the arcuate portion 106 at point 109. A spring assembly and damping means 117 includes a lower plate connector 118 connected to the cable segment 107*a* at point 119, a slidable or movable upper plate 120 spaced from the lower plate 118, and a spring 121. Plate 120 is abutted against pulley 113 whereby the spring 121 can be compressed when closing the gate to produce a bias in the spring to assist in opening the gate. The counterbalancing created by the bias in spring 121 acts through a lever arm defined between pivot point 43′ and point 108. In an identical manner as was described in the lower rail cable system 86, the toggle 122 provides means for adjusting the tension in cable segments 107*a* and 107*b*.

The top rail cable system 125 includes a top rail member 24′ having a arcuate portion. A cable including cable segments 127*a* and 127*b* is connected to the arcuate portion at points 128 and 129 respectively. A drive pulley 130 rotates in a counterclockwise direction to raise the top rail 24′. The cable segments pass around the idler pulley 131, 132, 133, 134 and 135 in a manner similar to that discussed previously.

A spring assembly and damping means 137 includes a lower plate 138 connected to the cable segment 127*a* at 139, an upper slidable plate 140 spaced from the lower plate 138, and a coil spring 141. As the rail member is lowered, plate 140 contacts pulley 132 to allow spring 141 to become compressed. The bias in spring 141 after it is compressed tends to counterbalance the weight of the rail 24′. The counterbalancing action of the spring 137 acts through lever arm defined between pivot point 44′ and point 128.

It is, therefore, seen that the gate 15 and 15′ of the present invention provide a vertically opening gate without any overhead mechanism that is extremely lightweight and functional. The rails 22, 23 and 24 are all interconnected for concurrent movement in parallel non-intersecting vertical planes. Counterbalancing of the rails is provided for efficient movement of the rail members to the upright open position. Pockets enclose the mechanical workings for safety and appearance as well as protection from the elements.

Although the invention has been described with a certain degree of particularity, nothing contained herein should serve to limit the scope of the invention, especially as defined in the appended claims.

What is claimed is:

1. A gate mechanism, comprising in combination, support post means and a plurality of rails, each of said rails being pivotally connected to said support post means for movement in parallel planes between a horizontal closed position and a vertical open position, drive means for driving each of said rails in concurrent pivotal movement, said drive means being operably connected to each of said rails near said pivotal connection.

2. The invention as defined in claim 1 wherein said support post includes a plurality of pockets and wherein each of said rails is mounted in a pocket.

3. The invention as defined in claim 2 wherein a portion of said drive means is positioned in each pocket containing a rail and is associated with the rail in the associated pocket and includes damping means for providing smooth concurrent movement of the respective rails.

4. The invention as defined in claim 2 wherein said drive means includes a motor and interconnecting means, said interconnecting means including counterbalancing means for assisting said motor in raising said rails to the vertical open position.

5. The invention as defined in claim 1 wherein there is an interconnecting means associated with each rail and includes a cable fixedly connected to one end of said rail, said cable passing around a pulley rotated by a drive shaft connected to said motor.

6. The invention as defined in claim 5 wherein said cable associated with each rail further includes damping means for smooth concurrent movement of the respective rails.

7. The invention as defined in claim 5 wherein each of said interconnecting means includes counterbalancing means for assisting said motor in driving said interconnecting means in raising said rails to the vertical open position.

* * * * *